US007140314B2

(12) United States Patent
Kamio

(10) Patent No.: US 7,140,314 B2
(45) Date of Patent: Nov. 28, 2006

(54) STAND-UP TYPE PERSONAL WATERCRAFT

(75) Inventor: Kunihiko Kamio, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/126,079

(22) Filed: May 9, 2005

(65) Prior Publication Data

US 2005/0247247 A1 Nov. 10, 2005

(30) Foreign Application Priority Data

May 10, 2004 (JP) ..... 2004-139867

(51) Int. Cl.
*B63B 35/73* (2006.01)
*B63H 11/08* (2006.01)

(52) U.S. Cl. ..... 114/55.52; 114/55.56; 440/2

(58) Field of Classification Search ..... 114/55.5, 114/55.52, 55.56, 55.58; 440/2, 1; 340/984, 340/425.5, 441
See application file for complete search history.

(56) References Cited

U.S. PATENT DOCUMENTS 4,680,575 A * 7/1987 Yazaki ..... 340/624
5,076,191 A * 12/1991 Madore ..... 114/55.52
5,103,673 A * 4/1992 Sawada et al. ..... 73/313
5,216,421 A * 6/1993 Sawada et al. ..... 340/984
5,282,437 A * 2/1994 Avillez de Basto ..... 114/345
5,377,609 A * 1/1995 Miller ..... 114/144 R
5,390,622 A * 2/1995 Kishi et al. ..... 114/55.56
5,422,625 A * 6/1995 Sakaemura ..... 340/461
5,433,635 A * 7/1995 Kobayashi ..... 440/2
5,613,887 A * 3/1997 Kobayashi ..... 440/47
5,941,188 A * 8/1999 Takashima ..... 114/55.5
6,055,922 A * 5/2000 Madachi et al. ..... 114/144 R
6,276,291 B1 * 8/2001 Lapointe et al. ..... 114/144 R
6,864,806 B1 * 3/2005 Funayose et al. ..... 340/984

FOREIGN PATENT DOCUMENTS

JP 61244689 A * 10/1986
JP 07215279 A * 8/1995
JP 2504376 4/1996

* cited by examiner

*Primary Examiner*—Ajay Vasudeva
(74) *Attorney, Agent, or Firm*—Alleman Hall McCoy Russell & Tuttle LLP

(57) ABSTRACT

A stand-up type personal watercraft is disclosed. The stand-up type personal watercraft typically includes a body including a hull and a deck covering the hull from above and being provided with a foot deck on an upper surface of a rear portion thereof to allow a rider to ride thereon, a handle pole configured to extend rearward in a longitudinal direction of the body, the handle pole having a steering handle attached to a rear end portion thereof, the handle pole being configured to be mounted to the deck such that a front end portion of the handle pole is attached to a front portion of the deck and the handle pole is vertically pivotable around the front end portion thereof, and a display device mounted to the handle pole and configured to display information regarding the watercraft.

8 Claims, 6 Drawing Sheets

STAND-UP TYPE PERSONAL WATERCRAFT

BACKGROUND OF THE INVENTION

1. Field of the Invention

The present invention relates to a stand-up type personal watercraft, and more particularly to a stand-up type personal watercraft equipped with a display device mounted to a handle pole and configured to display information regarding an operation of the watercraft.

2. Description of the Related Art

Typically, stand-up type personal watercraft have a body including a hull and a deck covering the hull from above which are joined to each other at peripheries thereof. An engine is mounted in an inner space of the body. A water jet pump is mounted at a rear portion of the body. The engine is configured to drive the water jet pump, which ejects water rearward, and as the resulting reaction, the watercraft gains a propulsion force. The body has a foot deck on an upper surface of the rear portion thereof to allow a rider to ride thereon in a standing or kneeling position. A handle pole is pivotally mounted at a front end portion thereof to a front portion of the body. The handle pole extends rearward from a location where the front end portion of the handle pole is attached to the body, and a steering handle is attached to a rear end portion of the handle pole. The rider grips the steering handle to steer the watercraft in the standing or kneeling position on the foot deck. Such a personal watercraft is disclosed in Japanese Utility Model Application Publication No. 2504376.

The above mentioned stand-up type personal watercraft is not equipped with meters or gauges configured to indicate, for example, an amount of remaining fuel or oil to be presented to the rider. So, the rider has difficulty in obtaining this information during travel. When the watercraft is traveling over a long distance, the rider must often get out the watercraft and open an engine hood to check the amount of remaining fuel or oil.

In recent years, in order to properly control engine operation, personal watercraft are typically provided with a plurality of sensors to detect oil temperature, water temperature, rotation speeds of shafts, etc. These sensors are electrically coupled to an ECU (electric control unit) built in the body. The ECU is configured to receive detection signals from these sensors and to control the engine based on status information regarding an operating state of the watercraft. The ECU is programmed to control the operation of the engine properly to change the operating state of the watercraft if any of the sensors detects an abnormal state.

However, since the conventional stand-up personal watercraft is not equipped with the meters and gauges configured to indicate the status information of the watercraft which are detected by the sensors, the rider is not informed of this information during travel of the watercraft. As a result, the rider cannot specify a cause of some abnormality occurring in a running engine during travel.

SUMMARY OF THE INVENTION

The present invention addresses the above described condition, and an object of the present invention is to provide a stand-up type personal watercraft equipped with a display device which is mounted to a body of the watercraft and is configured to display status information of the watercraft to be presented to a rider riding on the watercraft.

According to one embodiment of the present invention, there is provided a stand-up type personal watercraft comprising a body including a hull and a deck covering the hull from above and being provided with a foot deck on an upper surface of a rear portion thereof to allow a rider to ride thereon; a handle pole configured to extend rearward in a longitudinal direction of the body, the handle pole having a steering handle attached to a rear end portion thereof, the handle pole being configured to be mounted to the deck such that a front end portion of the handle pole is attached to a front portion of the deck and the handle pole is vertically pivotable around the front end portion thereof; and a display device mounted to the handle pole and configured to display information regarding the watercraft.

In the above constructed stand-up type personal watercraft, the display device can be mounted at a location to enable a rider riding on the foot deck to easily and visually check information displayed on the display device. The display device is capable of displaying information regarding an abnormal state of the watercraft, as well as information including the amount of remaining fuel or oil, an oil temperature, a water temperature, etc, which are presented to the rider during travel.

The display device may be configured to be mountable to an upper portion of the handle pole and positioned between the steering handle and the front end portion of the handle pole. In addition, the watercraft may further comprise a cushion cover positioned behind the display device and configured to cover an upper surface of a rear portion of the handle pole. The display device is mounted at a suitable location to enable the rider in a standing or kneeling position on the foot deck to easily and visually check the information displayed on the display device.

The handle pole may be provided with a concave portion configured to be recessed downward in the upper portion thereof, and the display device may be configured to be mountable to the concave portion of the handle pole. Since the display device is configured not to protrude from the upper surface of the handle pole, limitation on a design of the watercraft is minimized.

The handle pole may be formed by a hollow tube. A first drain hole may be formed in a bottom portion of the concave portion of the handle pole and a second drain hole may be formed in a lower portion of the handle pole. The watercraft may further comprise a drain pipe mounted within the handle pole and configured to allow the first drain hole and the second drain hole to communicate with each other. In this construction, water entering the concave portion of the handle pole when the watercraft is traveling in a heavy surf is discharged downward of the handle pole through the drain pipe. Therefore, the rider can visually check the information displayed on the display device even when the watercraft is traveling in a heavy surf.

The concave portion of the handle pole may be configured to be removably attachable to the handle pole and may be removably attachable to a mounting hole formed on an upper surface of the handle pole from above. In this construction, maintenance, for example, electric wiring between the display device mounted to the concave portion and an ECU built into the body, or the like, is easily carried out.

The concave portion may include a first inclined portion extending downward and forward from an upper face of the handle pole, and a second inclined portion extending upward and forward from a front end of the first inclined portion and having an inclined face facing rearward and upward. The display device may include a display portion mounted to the inclined face of the second inclined portion.

The above and further objects and features of the invention will more fully be apparent from the following detailed description with accompanying drawings.

DETAILED DESCRIPTION OF THE PREFERRED EMBODIMENTS

Figure 1:
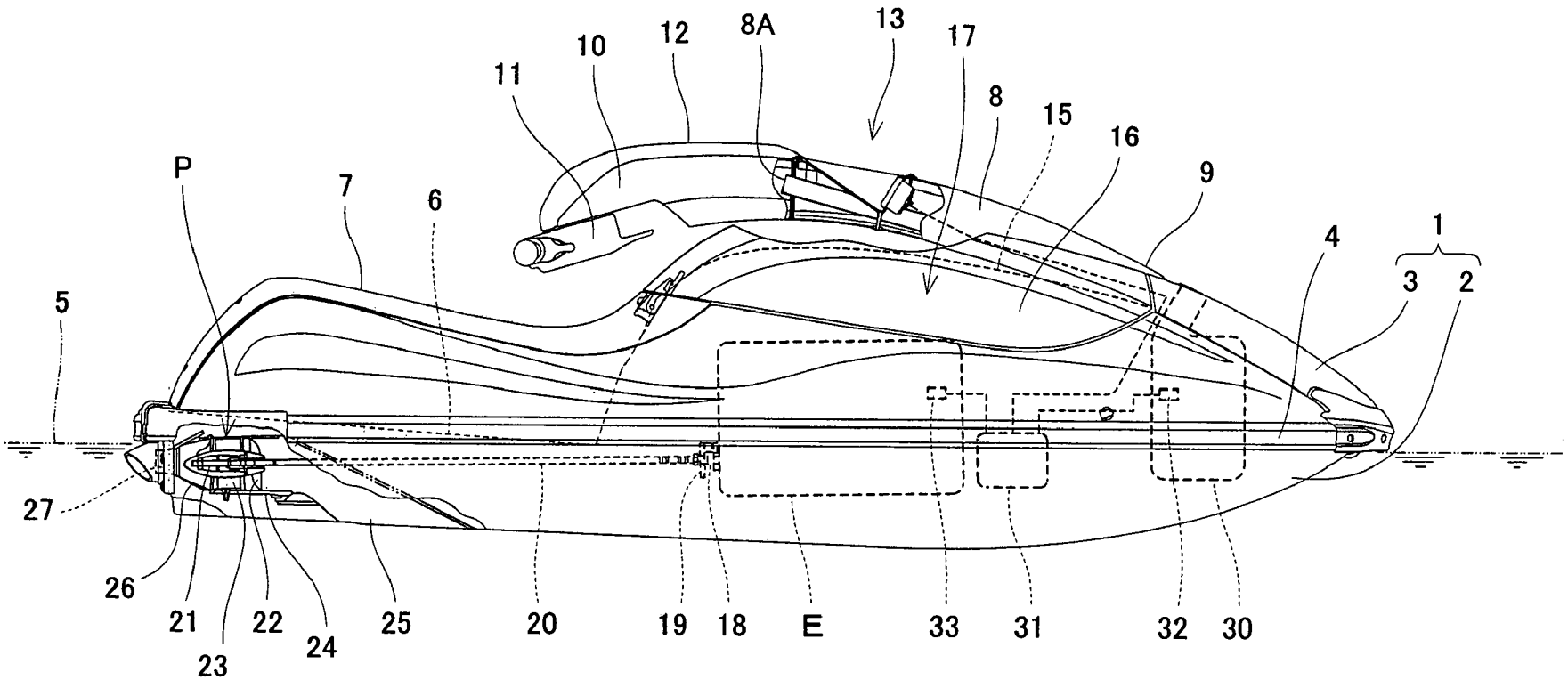
FIG. 1 is a side view of a stand-up type personal watercraft according to an embodiment of the present invention.

Hereinafter, a stand-up type personal watercraft according to an embodiment of the present invention will be described with reference to the drawings. Turning now to FIG. 1, a stand-up type personal watercraft is shown, as having a body 1 including a hull 2 and a deck 3 covering the deck 2 from above. The hull 2 and the deck 3 are joined to each other over an entire periphery by a gunnel line 4. In FIG. 1, reference designator 5 denotes a waterline in a state in which the watercraft is at rest in the water.

Figure 2:
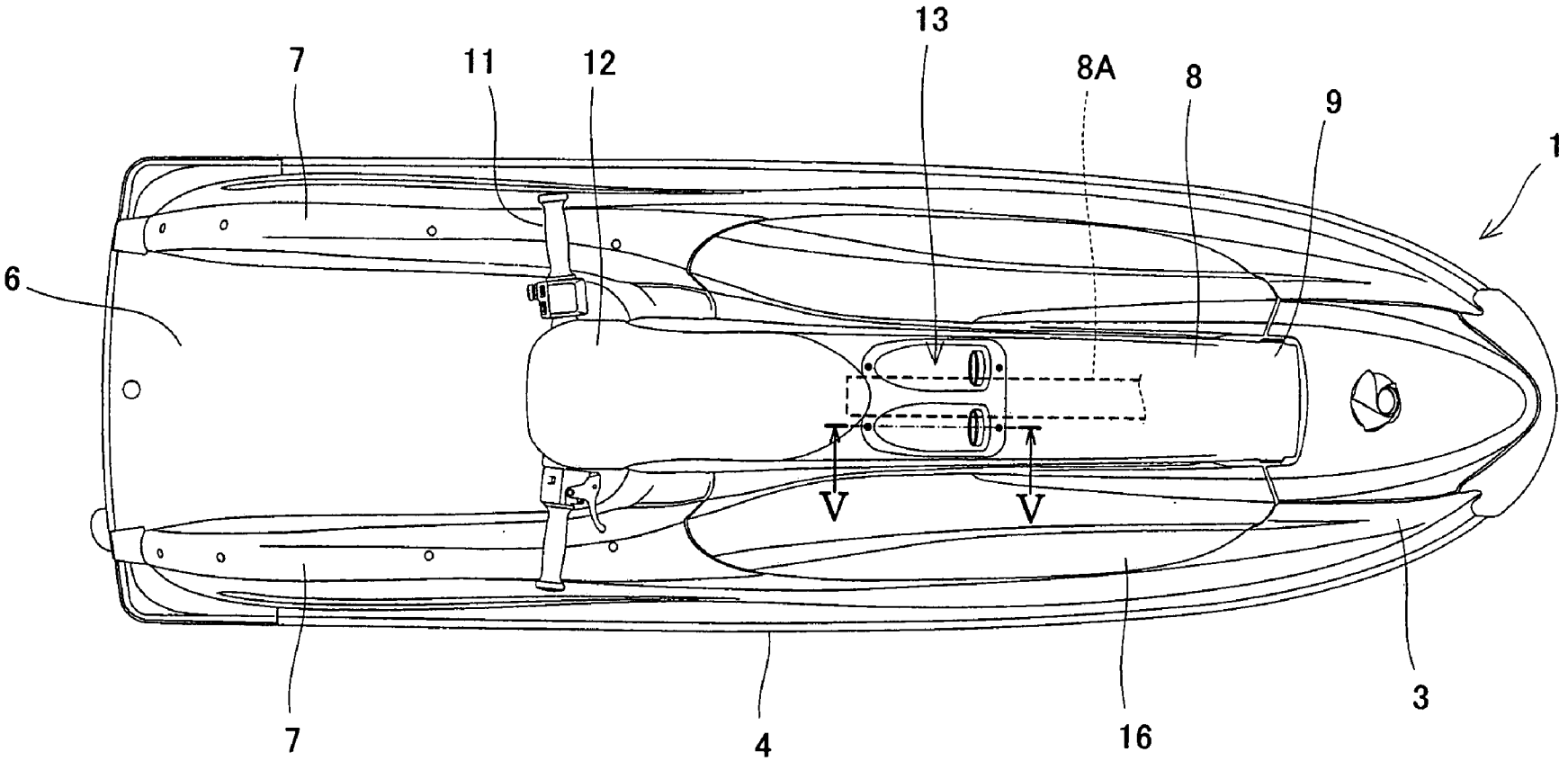
FIG. 2 is a plan view of the personal watercraft of FIG. 1.

As shown in FIGS. 1 and 2, a flat foot deck 6 is provided on an upper surface of a center section in a width direction of the deck 3 so as to extend from a vicinity of a center in a longitudinal direction of the body 1 to a rear end of the body 1. A rider steers the watercraft riding on the foot deck 6 in a standing or kneeling position. Deck fins 7 are mounted to right and left ends of the foot deck 6 and configured to protrude upward from the foot deck 6. In FIG. 1, only the right deck fin 7 is illustrated. The deck fins 7 extend from the vicinity of the center in the longitudinal direction of the body 1 to the rear end of the body 1.

A handle pole (also referred to as a steering column) 8 is mounted over the deck 3. As shown in FIG. 1, the handle pole 8 is bar-shaped to form a hollow tube having a substantially rectangular transverse cross-section. The handle pole 8 is curved such that its center section in the longitudinal direction thereof protrudes to be slightly higher than both of its end portions as viewed from the side. The handle pole 8 is pivotally mounted to the deck 3 such that a rear end portion 10 to which a steering handle 11 is attached is vertically pivotable around a front end portion 9 attached to a front portion of the deck 3. The handle pole 8 contains a wiring pipe 8A within which a cable (not shown) connecting the steering handle 11 to various components mounted within the body 1 extends.

A cushion cover 12 is provided to cover a rear portion of the handle pole 8 from above and is made of an elastic material to protect the rider. More specifically, the cushion cover 12 extends over an upper surface of the rear portion of the handle pole 8, which is approximately equal to one third an overall length of the handle pole 8. A display device 13 is mounted to an upper portion of the handle pole 8 to be located near and in front of the cushion cover 12, i.e., an upper portion of the center section of the handle pole 8.

A deck opening 15 is formed in the deck 3 to extend from the vicinity of the center in the longitudinal direction of the body 1 to a vicinity of a location where the front end portion 9 of the handle pole 8 is attached to the deck 3 to allow an inside and an outside of the body 1 to communicate with each other. A deck hood (engine hood) 16 is removably mounted over the deck opening 15. An engine room 17 is formed inside the body 1 to be positioned forward of the foot deck 6 and below the deck opening 15. An engine E is mounted in the engine room 17. In this embodiment, the engine E is a four-cycle inline four-cylinder engine. The engine E is mounted in the engine room 17 such that a crankshaft 18 extends along the longitudinal direction of the body 1.

A rear end of the crankshaft 18 is coupled to a propeller shaft 20 through a coupling means 19. The propeller shaft 20 is connected to a pump shaft 21 of a water jet pump P provided at a rear portion of the body 1. Therefore, the pump shaft 21 is rotatably and integrally coupled to the crankshaft 18. An impeller 22 is attached on the pump shaft 21. Fairing vanes 23 are provided behind the impeller 22. The impeller 22 is covered with a pump casing 24 on the outer periphery thereof.

A water intake 25 is provided on the bottom of the body 1. The water intake 25 is connected to the pump casing 24 through a water passage. The pump casing 24 is connected to a pump nozzle 26 provided on the rear side of the body 1. The pump nozzle 26 has a cross-sectional area that is gradually reduced rearward, and an outlet port 27 is provided on the rear end of the pump nozzle 26. The water outside the watercraft is sucked from the water intake 25 and fed to the water jet pump P. The water jet pump P pressurizes and accelerates the water and fairing vanes 23 guide water flow behind the impeller 22. The water is ejected rearward through the pump nozzle 26 and from the outlet port 27. As the resulting reaction, the watercraft obtains a propulsion force.

As shown in FIG. 1, a fuel tank 30 is mounted in a front portion inside the body 1. An ECU 31 is equipped inside the body 1 and is electrically coupled to various sensors including a fuel amount sensor 32 attached to the fuel tank 30, a crank position sensor 33 attached to the engine E, and to the display device 13 mounted to the handle pole 8.

Figure 3:
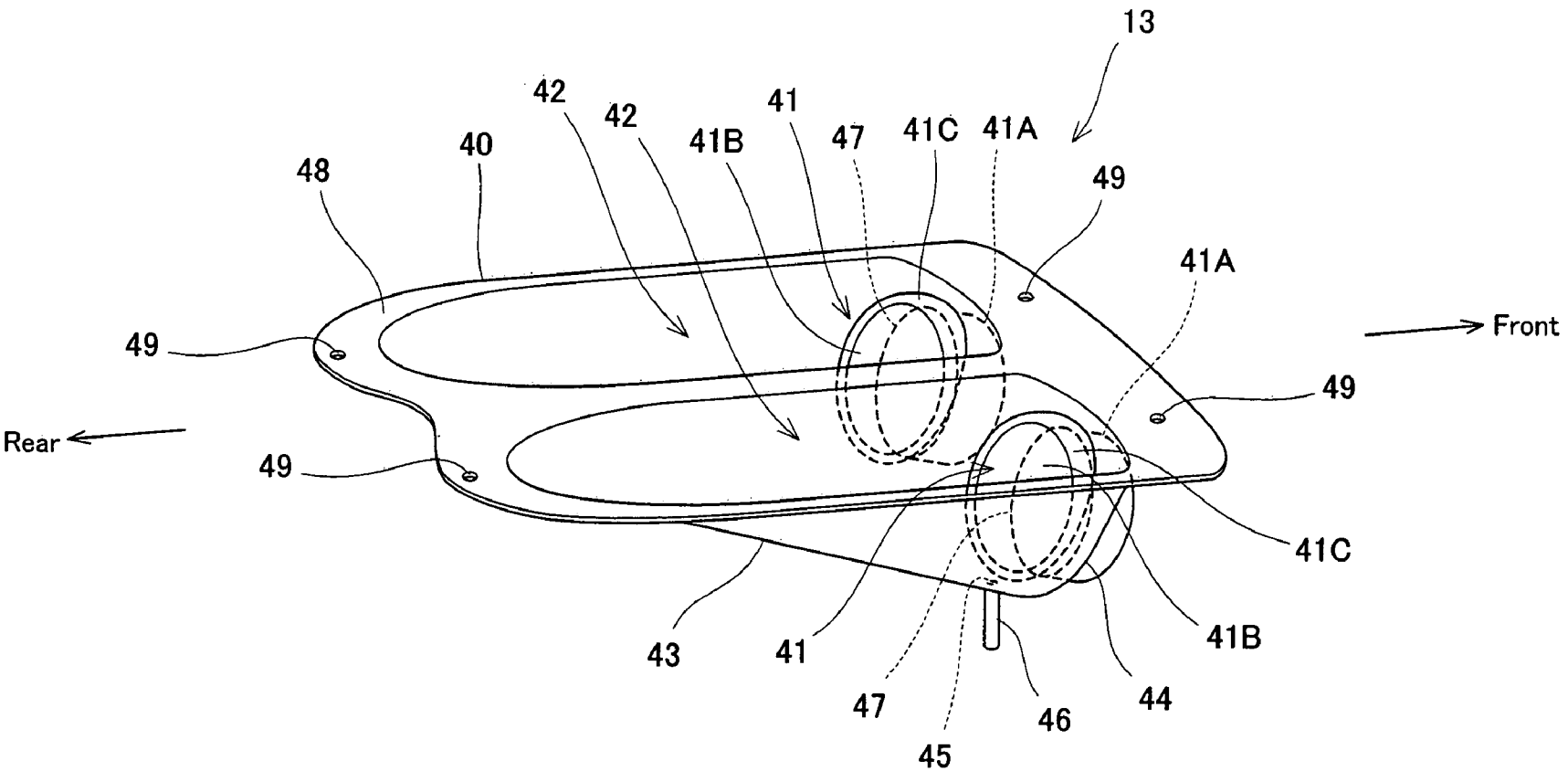
FIG. 3 is a perspective view showing a construction of a display device equipped in the personal watercraft of FIG. 1.

FIG. 3 is a perspective view showing a construction of the display device 13. As shown in FIG. 3, the display device 13 includes a cover 40, and two display instruments 41, which may be digital or analog meters, gauges or the like, mounted to the cover 40. The cover 40 is made of synthetic resin and has a unitary molded structure which is substantially rectangular as viewed from above. The two display instruments 41 are typically substantially cylindrical. The cover 40 is provided with concave portions 42 each including a gradually inclined portion (first inclined portion) 43 and steeply inclined portion (second inclined portion) 44. The gradually inclined portion 43 has a circular-arc shaped transverse cross-section and is gradually inclined downward and forward. The steeply inclined portion 44 extends from a front end of the gradually inclined portion 43 to be steeply inclined upward and forward. A connecting portion between the gradually inclined portion 43 and the steeply inclined portion 44 forms a deepest portion of the concave portion 42, into which a first drain hole 45 penetrates. A drain pipe 46 is connected to a lower portion of the concave portion 42 so as to communicate with the first drain hole 45 and configured to extend downward from the first drain hole 45.

A hole 47 is formed in the steeply inclined portion 44 of each concave portion 42 to allow the meter 41 to be mounted thereto. The meter 41 is fitted into the hole 47 from the direction in which the concave portion 42 opens. The meter 41 includes a cylindrical base portion 41A and a circular panel portion 41B attached to an outer end face of the base portion 41A. The base portion 41A is fitted into the hole 47 of the concave portion 42. A peripheral edge portion 41C of the panel portion 41B has a diameter larger than that of the base portion 41A. An inner face of the peripheral edge portion 41C is in close contact with the steeply inclined portion 44, thereby allowing the hole 47 of the concave portion 42 to be sealed. With the meter 41 mounted to the cover 40, the panel portion 41B of the meter 41 faces upward and rearward.

A flat flange portion 48 is formed at a peripheral edge portion of the cover 40 to enclose the concave portions 42. First bolt holes 49 are formed to penetrate the flange portion 48 at locations (four locations) forward and rearward of the concave portions 42.

Figure 4:
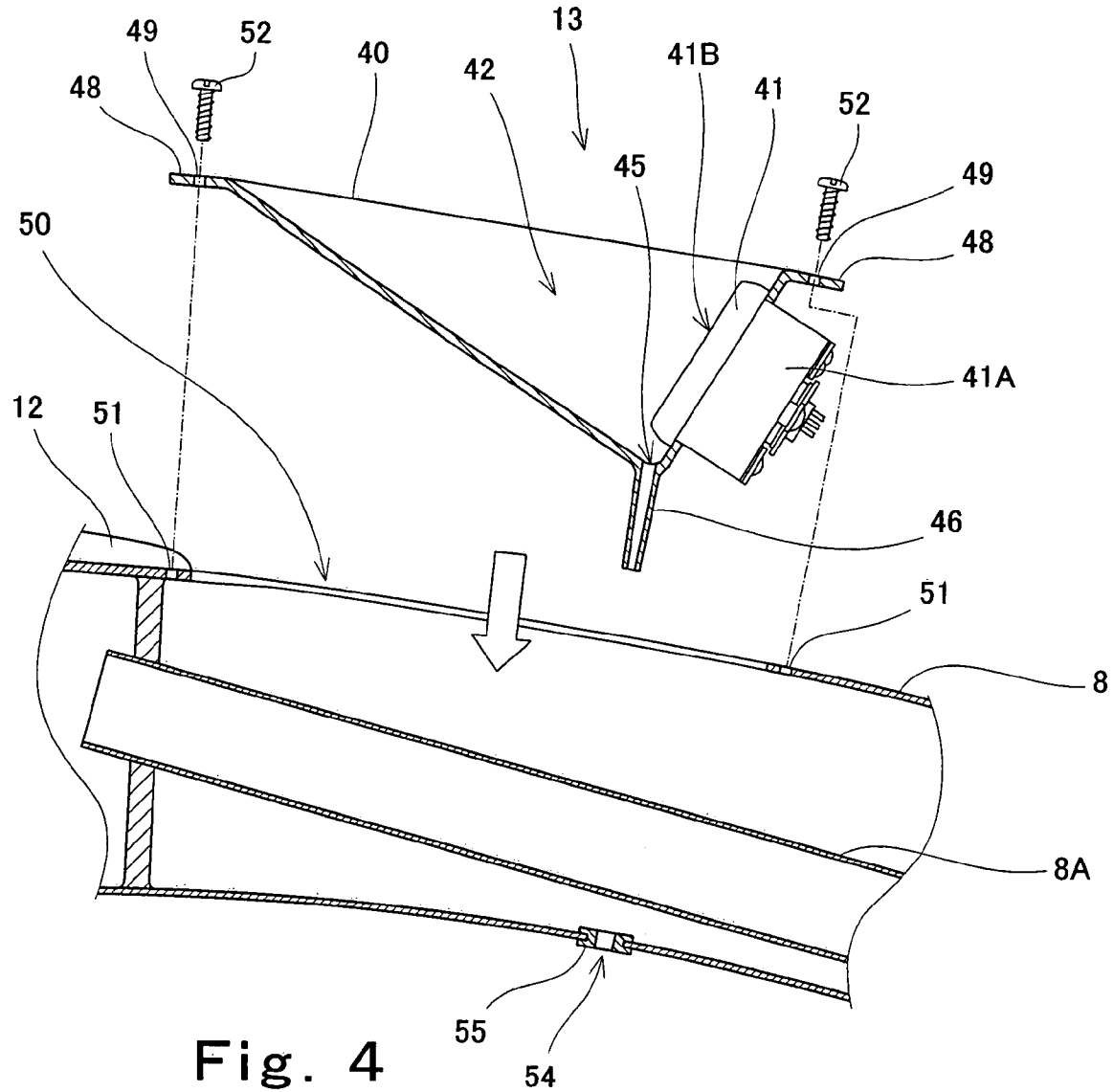
FIG. 4 is a cross-sectional view showing how the display device is mounted to a handle pole, and is an exploded view of a construction of FIG. 5.
Figure 5:
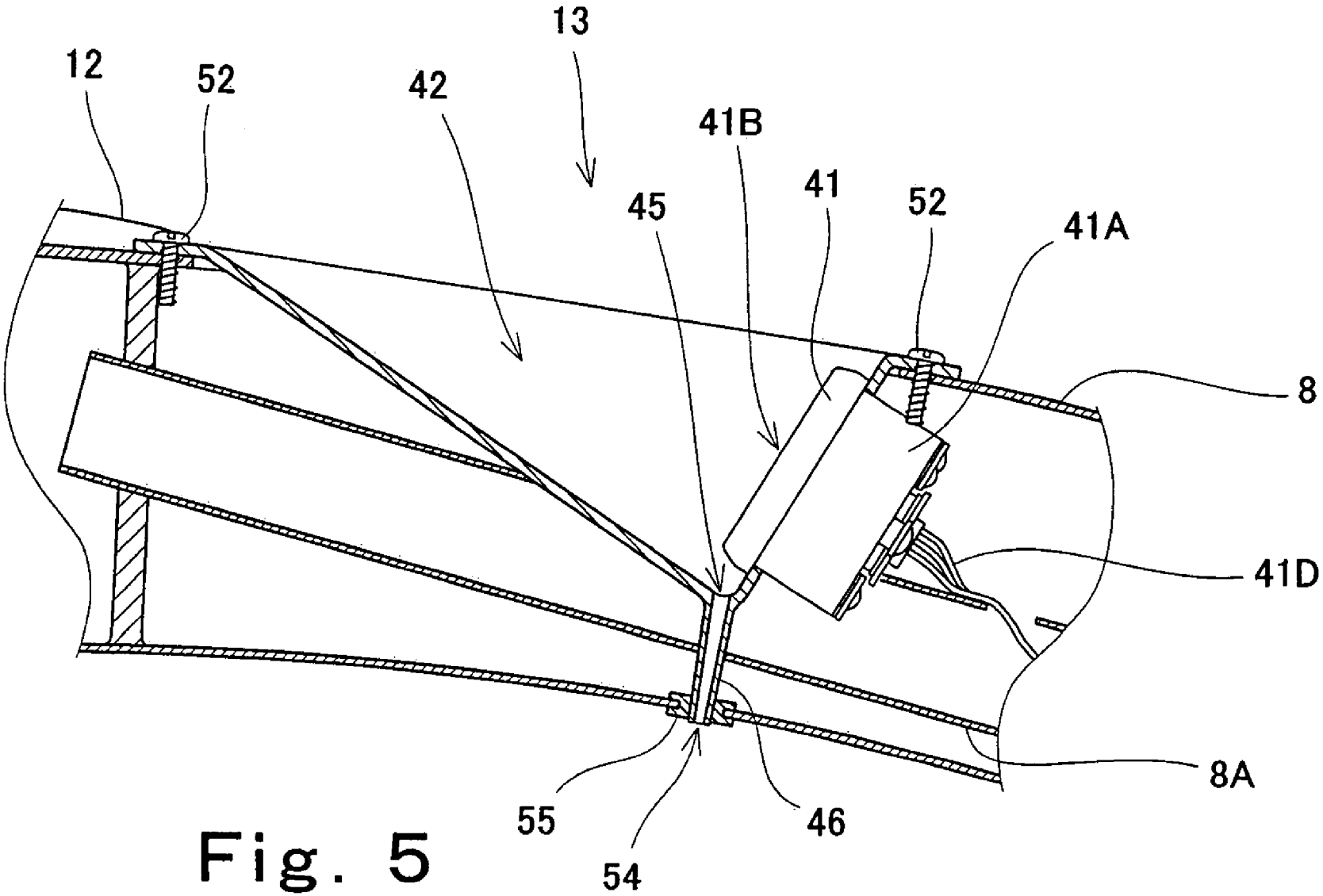
FIG. 5 is a partial cross-sectional view of the personal watercraft of FIG. 2, which is taken substantially along line V—V of FIG. 2, showing the display device mounted to the handle pole.

FIG. 4 is an exploded cross-sectional view of FIG. 5, showing how the display device 13 is mounted to the handle pole 8. FIG. 5 is a partial cross-sectional view of the personal watercraft of FIG. 2, which is taken substantially along line V—V, showing a state in which the display device 13 is mounted to the handle pole 8. As shown in FIG. 4, a mounting hole 50 is formed on the upper surface of the handle pole 8 to be located in front of the cushion cover 12 to allow the display device 13 to be mounted to the handle pole 8. In addition, second bolt holes 51 are formed to penetrate an upper wall portion of the handle pole 8 in the vicinity of and forward and rearward of the mounting hole 50 so as to respectively correspond to the first bolt holes 49 of the cover 40. As shown in FIGS. 4 and 5, the display device 13 is constructed such that the meters 41 are mounted to the cover 40, and is fitted into the mounting hole 50 from above. The display device 13 is fastened to the upper portion of the handle pole 8 by bolts 52 inserted into the first bolt holes 49 formed in the flange portion 48 of the cover 40 and into the second bolt holes 51 formed in the handle pole 8.

As shown in FIG. 4, right and left second drain holes 54 (only the right second drain hole 54 is illustrated in FIG. 4) are formed to penetrate a lower wall portion of the handle pole 8 to be located below the mounting hole 50. An annular grommet 55 which is made of rubber is fitted to the second drain hole 54. When the display device 13 is fitted from above into the mounting hole 50 formed in the handle pole 8, a lower end portion of the drain pipe 46 extending from the lower portion of the cover 40 of the display device 13 is fitted to the second drain hole 54 with the grommet 55 interposed between them (FIG. 5). Since the first drain hole 45 and the second water drain hole 54 communicate with each other through the drain pipe 46, water in the concave portion 42 of the display device 13 flows downward through the drain pipe 46 and is discharged outside from the second drain hole 54. In addition, since the grommet 55 seals the drain pipe 46 and the second drain hole 54, entry of the water from the second drain hole 54 into the handle pole 8 is inhibited.

The wiring pipe 8A is mounted to extend within the handle pole 8 as described above. The wiring pipe 8A extends between the right and left concave portions 42 of the display device 13 (see FIG. 2). An electric cable 41D extends from an inner side of the base portion 41A of the meter 41 and enters an inside of the wiring pipe 8A at a position, and further extends within the wiring pipe 8A and through an inside of the body 1 of the watercraft, and is connected to the ECU 31. A part or all of information which the ECU 31 obtains from the various sensors such as the fuel amount sensor 32 and the crank position sensor 33 are sent to the meter 41 through the electric cable 41D, and is displayed on the panel portion 41B.

The display device 13 is removably mounted to the handle pole 8 by the bolts 52. When watercraft are not equipped with the display device 12, the mounting hole 50 formed on the upper face of the handle pole 52 is closed by a cover member. In other words, it is not necessary to manufacture a handle pole which is not provided with a mounting hole. In addition, since the display device 13 is configured not to protrude from the upper surface of the handle pole 8 as shown in FIGS. 1 and 5, an increase in air resistance can be inhibited while the watercraft is traveling.

Figure 6:
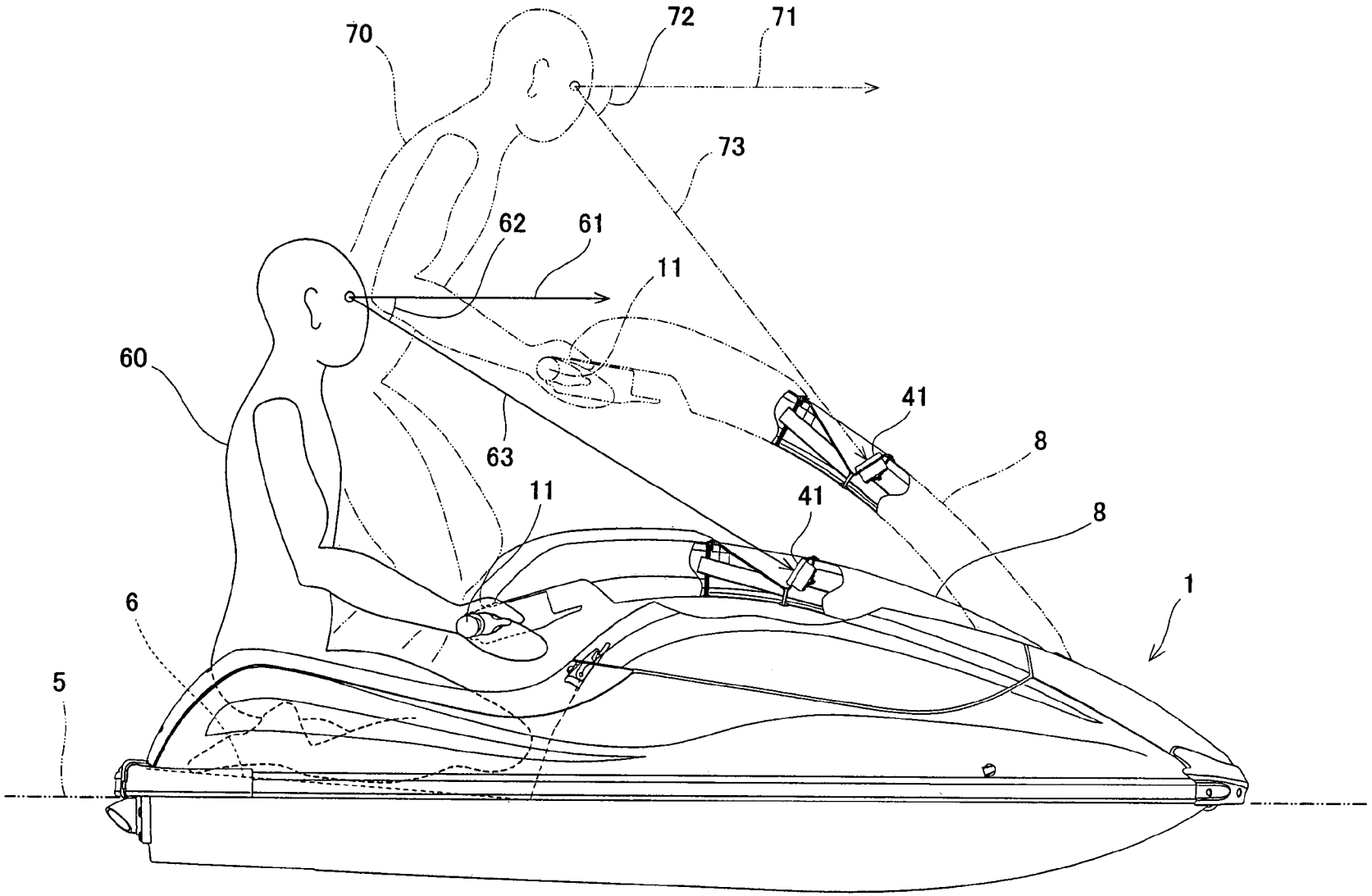
FIG. 6 is a side view schematically illustrating directions of eyes of a rider who is looking forward or looking at a meter or gauge in standing and kneeling positions on a foot deck.

FIG. 6 is a side view schematically illustrating directions of eyes of the rider who is looking forward and looking at the meter 41 in standing and kneeling positions on the foot deck 6. In FIG. 6, the direction of eyes of the rider in the kneeling position is indicated by a solid line and the direction of eyes of the rider in the standing position is indicated by a two-dotted line.

As shown in FIG. 6, a rider 60 steering the watercraft in the kneeling position on the foot deck 6 lowers the direction of eyes 61 looking forward by a relatively small angle 62 to see the meter 41 located below, as indicated by 63. In addition, a rider 70 steering the watercraft in the standing position on the foot deck 6 lowers direction of eyes 71 looking forward by a relatively small angle 72 to see the meter 41 located below, as indicated by 73. Since the display device 13 of this embodiment is positioned in the center section in the longitudinal direction of the handle pole 8 which is curved to protrude slightly upward, the rider riding on the foot deck 6 can see the meter 41 by slightly changing the direction of eyes during the travel.

As should be appreciated from the foregoing, in accordance with the stand-up type personal watercraft of this embodiment, the rider riding on the foot deck 6 in the kneeling or standing position can visually check the meter 41 easily. Therefore, the rider easily obtains information regarding the watercraft such as the amount of remaining oil, the oil temperature, the water temperature, and the engine speed of the engine E.

Alternatively, the display device 13 may be mounted to a location forward of the center section of the handle pole 8, or otherwise, may be mounted to a side portion of the handle pole 8. In addition, the display device 13 may be constructed such that the meters 41 are directly attached to the upper face of the handle pole 8 without the cover 40.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A stand-up type personal watercraft comprising:

a body including a hull and a deck covering the hull from above, the body having a centrally positioned foot deck on which an operator rides, the foot deck extending longitudinally and substantially between a handle pole and a rear end portion of the deck;

an engine disposed within the body forward of the foot deck and substantially at a center position in a longitudinal direction of the body;

wherein the handle pole is configured to extend rearward in a longitudinal direction of the body, the handle pole having a steering handle attached to a rear end portion thereof, the handle pole being configured to be mounted to the deck such that a front end portion of the handle pole is attached to a front portion of the deck and the handle pole is vertically pivotable around the front end portion thereof; and a display device mounted to the handle pole and configured to display information regarding the watercraft, the display device including an instrument panel portion which has a panel surface oriented rearward.

2. The stand-up type personal watercraft according to claim 1, wherein the display device is configured to be mountable to an upper surface portion of the handle pole and positioned between the steering handle and the front end portion of the handle pole.

3. The stand-up type personal watercraft according to claim 2, further comprising a cushion cover positioned behind the display device and configured to cover an upper surface of a rear portion of the handle pole.

4. The stand-up type personal watercraft according to claim 2, wherein the handle pole is provided with a concave portion configured to be recessed downward and to open upward in the upper surface portion thereof, and the display device is configured to be mountable to the concave portion of the handle pole.

5. A stand-up type personal watercraft comprising:

a body including a hull and a deck covering the hull from above and being provided with a foot deck on an upper surface of a rear portion thereof to allow a rider to ride thereon;

a handle pole including a hollow tube and configured to extend rearward in a longitudinal direction of the body, the handle pole having a steering handle attached to a rear end portion thereof, the handle pole being configured to be mounted to the deck such that a front end portion of the handle pole is attached to a front portion of the deck and the handle pole is vertically pivotable around the front end portion thereof; and a display device mounted to the handle pole and configured to display information regarding the watercraft;

wherein the display device is configured to be mountable to an upper portion of the handle pole and positioned between the steering handle and the front end portion of the handle pole;

wherein the handle pole is provided with a concave portion configured to be recessed downward in the upper portion thereof, and the display device is configured to be mountable to the concave portion of the handle pole; and wherein a first drain hole is formed in a bottom portion of the concave portion of the handle pole and a second drain hole is formed in a lower portion of the handle pole, the watercraft further comprising:

a drain pipe mounted within the handle pole and configured to allow the first drain hole and the second drain hole to communicate with each other.

6. The stand-up type personal watercraft according to claim 4, wherein the concave portion of the handle pole is configured to be removably attached to handle pole.

7. The stand-up type personal watercraft according to claim 6, wherein the concave portion of the handle pole is removably attachable to a mounting hole formed on the upper surface portion of the handle pole from above.

8. A stand-up type personal watercraft comprising:

a body including a hull and a deck covering the hull from above, the body having a centrally positioned foot deck on which an operator rides, the foot deck extending longitudinally and substantially between a handle pole and a rear end portion of the deck;

an engine disposed within the body forward of the foot deck and substantially at a center position in a longitudinal direction of the body;

wherein the handle pole is configured to extend rearward in a longitudinal direction of the body, the handle pole having a steering handle attached to a rear end portion thereof, the handle pole being configured to be mounted to the deck such that a front end portion of the handle pole is attached to a front portion of the deck and the handle pole is vertically pivotable around the front end portion thereof; and a display device mounted to the handle pole and configured to display information regarding the watercraft;

wherein the display device is configured to be mountable to an upper portion of the handle pole and positioned between the steering handle and the front end portion of the handle pole;

wherein the handle pole is provided with a concave portion configured to be recessed downward and open upward in the upper portion thereof, and the display device is configured to be mountable to the concave portion of the handle pole; and wherein the concave portion includes a first inclined portion extending downward and forward from an upper face of the handle pole, and a second inclined portion extending upward and forward from a front end of the first inclined portion and having an inclined face facing rearward and upward, the display device including a display instrument mounted to the inclined face of the second inclined portion.

* * * * *